US006116927A

United States Patent [19]

Johnson et al.

[11] Patent Number: 6,116,927

[45] Date of Patent: Sep. 12, 2000

[54] ELECTRICAL CONNECTOR FOR USE BETWEEN MEDIA CONNECTORS AND COMPUTER COMMUNICATIONS CARDS

[75] Inventors: Thomas A. Johnson, Draper; John D. Frampton, West Valley City, both of Utah; Donald C. Paul, Downers Grove; Jeffrey S. Terrell, Bolingbrook, both of Ill.

[73] Assignee: 3Com Corporation, Santa Clara, Calif.

[21] Appl. No.: 09/033,270

[22] Filed: Mar. 2, 1998

[51] Int. Cl.[7] ..... H01R 13/44

[52] U.S. Cl. ..... 439/131; 439/946

[58] Field of Search ..... 439/131, 946

[56] References Cited

U.S. PATENT DOCUMENTS

| | | | |
|---|---|---|---|
| 2,916,720 | 12/1959 | Steans | 339/91 |
| 4,241,974 | 12/1980 | Hardesty | 339/154 |
| 4,303,296 | 12/1981 | Spalding | 339/122 |
| 4,407,559 | 10/1983 | Meyer | 339/126 |
| 4,428,636 | 1/1984 | Kam et al. | 339/97 |
| 4,710,136 | 12/1987 | Suzuki | 439/374 |
| 4,915,648 | 4/1990 | Takase et al. | 439/490 |
| 5,139,439 | 8/1992 | Shie | 439/359 |
| 5,183,404 | 2/1993 | Aldous et al. | 439/55 |
| 5,336,099 | 8/1994 | Aldous et al. | 439/131 |
| 5,338,210 | 8/1994 | Beckham et al. | 439/131 |
| 5,411,405 | 5/1994 | McDaniels et al. | 439/131 |
| 5,499,923 | 3/1996 | Archibald et al. | 439/26 |
| 5,505,633 | 4/1996 | Broadbent | 439/329 |
| 5,509,811 | 4/1996 | Homic | 439/55 |
| 5,538,442 | 7/1996 | Okada | 439/676 |
| 5,547,401 | 8/1996 | Aldous et al. | 739/676 |
| 5,561,727 | 10/1996 | Akita et al. | 385/88 |
| 5,562,504 | 10/1996 | Moshayedi | 439/131 |
| 5,608,607 | 3/1997 | Dittmer | 361/686 |
| 5,634,802 | 6/1997 | Kerklaan | 439/131 |
| 5,660,568 | 8/1997 | Moshayedi | 439/654 |
| 5,679,013 | 10/1997 | Matsunaga et al. | 439/946 |
| 5,727,972 | 3/1998 | Aldous et al. | 439/655 |
| 5,773,332 | 6/1998 | Gilad | 439/344 |

FOREIGN PATENT DOCUMENTS

| | | |
|---|---|---|
| 61-256850 | 11/1986 | Japan . |
| WO 95/13633 | 5/1995 | WIPO . |

OTHER PUBLICATIONS

P.E. Knight and Smith Electrical Connector for Flat Flexible Cable Jun. 1982.

*Primary Examiner*—Neil Abrams
*Assistant Examiner*—Hae Moon Hyeon
*Attorney, Agent, or Firm*—Workman, Nydegger & Seeley

[57] ABSTRACT

An improved electrical connector for use in a communications card for interfacing between a media connector and a downsized computer is provided. In a preferred embodiment, the communications card comprises a retractable access portion and a fixed portion. The retractable access portion has an aperture formed therein configured to receive the media connector. A conductive terminal having a first and a second end mates with both the retractable access portion and the fixed portion. The first end makes electrical contact with the media connector while, simultaneously, the second end slidingly makes electrical contact with the fixed portion as the retractable access portion is extended beyond the computer housing during use. The sliding contact is accomplished by means of a conductive track disposed on the fixed portion. Since the fixed portion is in electrical communication with the computer, the media connector is also in electrical communication with the computer. A contact block may additionally be provided to align and electrically isolate the conductive track. A pin block having pivoting action is provided to accommodate the conductive terminal and to extend longevity of the conductive terminal. The pin block also ensures better electrical contact with the conductive track during use.

24 Claims, 3 Drawing Sheets

ELECTRICAL CONNECTOR FOR USE BETWEEN MEDIA CONNECTORS AND COMPUTER COMMUNICATIONS CARDS

BACKGROUND OF THE INVENTION

1. The Field of the Invention

The present invention relates generally to the interface between physical/electrical media connectors and a communications card in a computer system. More specifically the present invention relates to an improvement in the electrical connection therebetween.

2. The Relevant Technology

The field of transmission of data by phone lines or network cables is a rapidly expanding field. Users of personal computers in particular are finding such practice to be of great value.

For example, there are numerous public and private networks and databases which store data or programs. Absent the ability to send and receive data over telephone lines through a modem, a user is relegated to relying upon the exchange of discs or tapes in order to receive data suitable for use with their computer.

Similarly, companies performing tasks that are integrated are aided by local area networks ("LANs") which permit personnel to exchange electronically retrievable data. The ability to freely transfer data and information from one computer to another computer over a telephone line may dramatically increase productivity and reduce overall production time.

To translate the binary code utilized by a computer into signals capable of being transmitted over the telephone lines, modems have been developed to translate and reconfigure binary signals into analog signals capable of being transmitted over telephone lines. For conversion of signals to take place, a modem must be placed between the computer generating the binary signals and the telephone line capable of carrying the analog signals.

Typically, in today's practice, a modem at the transmitting computer end of a telephone line receives binary digital data from the computer and converts the binary code received from the computer into modem frequency signals. These modem frequency signals are then transmitted over the telephone lines to a receiving modem at the receiving computer.

The modem at the recipient's end then converts the modem frequency signal back to binary digital data characters and inputs the data characters to the input port of the receiving computer.

As today's modems serve to provide a compatible interface between the phone lines and the computer, the Federal Communications Commission ("FCC") and telephone companies require an interface to moderate all signals or energy being input into the phone lines. This interface protects the phone lines and systems from damage, thereby ensuring the integrity and quality of transmissions over the phone lines.

A required part of this interface is a Data Access Arrangement ("DAA") circuit. The DAA circuit provides an impedance match and also serves to isolate the modem and the computer from transient signals and other disturbances coming in over the phone line. The DAA also protects the phone line from disabling influences emanating from the computer or the modem.

For example, damage would occur to the telephone system if instead of transmitting frequency signals, DC power was transmitted over the phone lines. Because the modem is attached directly to the phone line, the modem must incorporate the required FCC interface and must comply with any requirements imposed by local telephone companies.

The ubiquity of the telephone and the need for interactive systems throughout the world have caused standards to be established for the components of a telephonic system. Standardization allows telephone systems and devices using those systems to be interchangeable. The components of the telephone that are most thoroughly standardized are physical/electrical media connectors.

Physical/electrical media connectors are used by almost all telephone companies throughout the world for many applications, the most important of which is interconnection of telephones with telephone lines. For this reason, stringent standardization of connectors is required if compatibility and interactivity is to be realized.

One popular physical/electrical media connector used in the United States of America is the RJ-11 6-position miniature modular plug physical/electrical media connector. The RJ-11 is used between the telephone line and the telephone itself.

Unfortunately, because of the physical and electrical differences between the many pins of the peripheral ports associated with the central processing unit of a computer and the 6 pins of the RJ-11, direct physical or electrical connection of the RJ-11 to the computer is not possible.

Consequently, it has been found necessary to employ modems or similar input/output devices or cards to effect communication between computers and telephone lines. Modems reconfigure binary data from the central processing unit of the computer as received through the multi-pin peripheral port. The reconfigured data is then transmitted in analog form through the RJ-11 physical/electrical media connector into the telephone line.

In contradistinction to the development of telephone lines, transmission lines used in LANs have been developed specifically for the transmission of computer generated signals. Because of the recent development of these transmission lines, a variety of internal configurations for transmission lines have been developed to accomplish the transmission of computer data between computers.

A typical local area network comprises several computers at remote locations throughout a building interconnected with unshielded twisted pair cable utilizing RJ-type physical/electrical media connectors. The network is typically connected to a file server. A file server is a computer providing shared access to a file system, printer, electronic mail service, or modem. The file server is a combination of hardware and software that contains files shared by everyone connected to the LAN.

As LANs utilizing unshielded twisted pair cable are capable of transmitting signals at a higher rate than signals traveling through telephone lines, the requirements of the devices used to translate and reconfigure signals from the computer for transmission through lines have consequently been developed with different requirements.

The counterpart to the modem in telephonic communications is the LAN adapter card or data communications card. In a similar fashion to a modem, these communications cards reconfigure the parallel data produced by the computer into a serial form and back. These cards also provide buffering, encoding and decoding, cable access, and transmission.

As the use of LANs increases, it has become increasingly more beneficial for users of portable computers to have the ability to interact with several local area networks at different locations. For example, information at one location may be downloaded to a portable computer that allows a user to manipulate the data during a business trip and load the manipulated data onto the network at a destination. Diagnostics and maintenance are also made easier through the use of common connectors.

As the popularity of twisted-pair cable has increased, the popularity of the most frequently used physical/electrical media connector, the 8-pin miniature modular plug, has also increased. This increase in popularity of the 8-pin miniature modular plug has introduced the same problems and solutions into LANs as will be discussed regarding the RJ-11 physical/electrical media connector in the development of modems.

Many modems in use today are configured as external accessory units, housed in their own cases, and attached to the computer. Typically, external modems are electrically connected to the telephone with a telephone extension line utilizing physical/electrical media connectors at each end. External modems are often employed by users of personal computers because they can easily contain a substantial amount of electronic circuitry or hardware, as well as executable programs or software.

With the advent of downsizing technology in computer components, however, smaller portable computers (often referred to as laptop or notebook computers) have taken the place of many of the desktop models which use external modems. With the new-found portability available with laptop or notebook computers, the size of external modems has proved cumbersome and been rendered obsolete in keeping with the portability that buyers of these downsized computers desire.

To overcome the inconvenience and physical limitations of external modems, smaller modems have been developed that are small enough to be built integrally within the housing of a portable computer. As a result, integral internal modems that interface with the ubiquitous RJ-11 system provides users of portable computers with internal modems having a uniform standard interface for media access devices such as modems. Now, modem manufacturers can build products capable of accepting the RJ-11 media connector with confidence that their product can be used in a wide geographical area. Because modems can be built to the RJ-11 uniform standard, consumers benefit from the ability to interchange and interconnect media access devices without the need for adapters for products made by different manufacturers.

As computer housings have continued to be downsized, internal spatial restrictions have required the establishment of standards for the internal accessories of the computer. One set of standards applicable to memory cards has been developed by the Personal Computer Memory Card International Association (PCMCIA). This organization is comprised of hundreds of manufacturers of memory cards and related peripheral equipment. By convention, the PCMCIA has determined that the spatial standard for all memory cards used in down-sized computers should be restricted to a rectangular space approximately 55 mm in width, 85 mm in length, and 5 mm in depth.

In keeping with the PCMCIA standards for memory cards, internal modem manufacturers have adopted the same spatial standards for use with their down-sized communications cards. By complying with the standards established by PCMCIA for memory cards, communications card manufacturers have assured themselves of compatibility and spatial conformity with computers utilizing the new PCMCIA standards.

The constraints imposed by this new PCMCIA standard have resulted in the development of "credit card" communications cards. Most of the components formerly housed within a modem are now contained within a credit card-sized device. Although many of the communication cards serve the functions of a modem, a similar card has been contemplated for use in LANs. Nonetheless, the problem will hereinafter be addressed in terms of the PCMCIA standard communications card.

Since the depth of a PCMCIA standard communications card is limited to 5 mm and the depth of a typical media connector, such as the RJ-11 type or 8-pin miniature modular plug, is approximately 8–12 mm, the typical media connector exceeds the depth restrictions imposed by the PCMCIA standards for internal computer components.

While many prior art devices have tried to solve the depth incompatibility problem between the PCMCIA standard communications card and the media connector, a "pop-out" or sliding interface device has emerged as a popular solution. The pop-out interface device, known commonly as the XJACK® initially produced by MEGAHERTZ Corp., now owned by 3 Com Corp., solves many of the interface problems posed by prior art devices. Such solved problems include, but are not limited to: (i) the elimination of carrying along an extra interfacing device compatible with both the media connector and the PCMCIA communications card; (ii) the elimination of ensuring a DAA in the interfacing device is compatible with the computer; (iii) the elimination of physical interference between adjacent PCMCIA communication cards in adjacent slots when the PCMCIA communication card has an enlarged portion thereof larger than the conventional 5 mm thickness; (iv) the elimination of potential breakage of the interface connector when not in use; and (v) the elimination of protrusions beyond the normal dimensions of the computer so that the computer portfolio is more compatible with devices typically transporting laptop computers.

With reference to FIG. 1, a typical embodiment of a sliding interface device in the form of a conventional 5 mm thick PCMCIA-architecture style communications card for directly interfacing with a media connector is depicted generally as 20. The communications card 29 defining the interface device 20 has a retractable access portion 22 and a fixed portion 24.

The fixed portion 24 is in electrical communication with a computer (not shown) by means of electronic circuitry connected on a printed circuit board (PCB) housed internally within the communications card 29. For brevity, fixed portion 24 may sometimes be referred to as the PCB 24 although the fixed portion includes more than just the PCB and electronic circuitry. The retractable access portion 22 is in electrical communication with the fixed portion 24 through a flexible wire ribbon 30. During use, in means well known in the art, the retractable access portion 22 slides in and out of a slot 32 formed within the PCB 24. The retractable access portion 22 is urged out of the slot 32 by a spring 34 biased, in a direction external to the computer housing, by a ledge 36 connected to the PCB 24. Although not shown, the computer housing during use is substantially parallel to an edge 37 of the communications card 29. A limiting notch 42 engaged by a biased lever 40 is used to restrict the travel distance of the interface device to a predetermined distance when the retractable access portion is urged in a direction external to the computer housing by the spring 34. After use, a retention notch 38 in combination with the biased lever 40 is used to retain the retractable access portion 22 within the housing of the computer.

An aperture 44 having a plurality of walls 46 is formed within the retractable access portion 22. The aperture 44 is so sized and shaped as to be capable of receiving a physical/electrical media connector. Formed within aperture 44 by means of walls 46 is a broad retention clip groove 48, a narrow retention clip groove 50, and a retention ridge 52. These structures within aperture 44 provide for the retention of a connector pin block of a physical/electrical media connector. A guide track 54 is formed within communications card 29 protruding upwardly from the bottom of communications card 29. Guide track 54 is interengaged with a corresponding guide groove formed in the bottom of retractable access portion 22.

When a user desires to connect a telephone line to the communications card, biased lever 40 is manipulated out of retention notch 38. As retractable access portion 22 is released from the grip of biased lever 40, tension applied by spring 34 urges retractable access portion 22 out of slot 32. The progress of retractable access portion 22 is guided by guide track 54 and is halted when biased lever 40 engages limiting notch 42. A user then inserts a physical/electrical media connector into aperture 44 to provide an electrical connection between communications card 29 and the telephone line. When a user no longer desires to access the retractable access portion 22, the user merely presses retractable access portion 22 back within the confines of the computer housing until the retention notch 38 is engaged by biased lever 40.

Although extremely effective as a device suitable for physically and electrically interfacing a PCMCIA communications card and a media connector, the sliding interface connectors are limited by certain inherent constraints. For example, the flexible wire ribbon 30 that is ultimately used to maintain electrical communication between the media connector and the computer is limited by the physical strength of its connectors. In particular, the flexible wire ribbon 30 is often soldered at both ends thereof about electrical leads 56 on both the retractable access portion 22 and the PCB 24. The solder connection, however, limits the useful life of the sliding interface device because every time the sliding interface connector is slid in and out of slot 32 the solder joints are repetitiously subject to mechanical stress and strain. Over time, the stress and strain subjects the joints to mechanical failure. Moreover, during the manufacturing process, soldering requires high temperatures which potentially serves to deform the materials used in the flexible wire ribbon 30. Often these materials are plastics and can be catastrophically destroyed. Additionally, during the solder manufacturing process, too much solder applied at areas of electrical connections causes the solder to spread out on the PCB and potentially causes electrical shorts.

Other inherent problems with the flexible wire ribbon 30 also exist because every time the sliding interface device is slid in and out of slot 32 the flexible wire ribbon flexes the metal conductors therein. Over time, this flexing may mechanically decrease the strength of the conductors and possibly subject them to breakage.

Still other limitations exist within the manufacturing process because the flexible wire ribbon is positioned on the PCB by techniques commonly known as "pick-and-place." Although generally effective, the pick-and-place process often "loses" the flexible wire ribbon as it is being positioned on the PCB. This losing then disrupts the manufacturing line, especially automated ones. It can also cause the flexible wire ribbon to be incorrectly positioned on the PCB. Moreover, pick-and-place may overstress the wires or conductors therein when maneuvering the flexible wire ribbon. This potentially causes breakage of the conductors.

Even further limitations exist with flexible wire ribbons. For example, in the past, zero-insertion-force (ZIF) connectors were frequently used to electrically connect the flexible wire ribbon to the PCB, instead of soldering. Although the ZIF connectors generally absorbed more stress and strain during the sliding in and out of the sliding interface devices, which prolonged the useful life of the flexible wire ribbon, ZIF connectors have proven to be extremely expensive over the production life of the sliding interface connectors.

Equally problematic for both the ZIF and solder methods of electrically connecting the flexible wire ribbon to the PCB is that these methods require attentive labor. Over time, labor hours detrimentally translate production thereof into a cost ineffective process.

Another inherent limitation is the spatial arrangement that must exist within the communications card to allow the sliding interface device to move freely, during use, without constriction from the flexible wire ribbon. Disadvantageously, the presently required spatial arrangement prevents the PCB from being larger within the housing of the communications card. In turn, the PCB is made smaller which prevents discrete components thereon from having any excess room during the manufacturing process. A small PCB also detracts from the inherent structural stability of the PCB.

Accordingly, it would be an advance to provide an improved electrical connection between the media connector and the communications card that substantially eliminates reliance upon expensive connectors, solder joints and flexible wires.

SUMMARY AND OBJECTS OF THE INVENTION

It is, therefore, an object of the present invention to provide an improved electrical connector for use between a media connector and a communications card that substantially eliminates reliance upon solder joints and bending wire conductors.

It is another object of the present invention to provide an improved electrical connector for use between a media connector and a communications card that economically improves the manufacturing thereof.

It is a further object of the present invention to provide an improved electrical connector for use between a media connector and a communications card that consumes less physical space within the communications card.

It is still a further object of the present invention to provide an improved electrical connector for use between a media connector and a communications card that substantially eliminates the possibility of electrically shorting components of the communications card during the manufacturing process.

In accordance with the invention as embodied and broadly described herein, the foregoing and other objectives are achieved by providing an improved electrical connector in a communications card for use in interfacing between a media connector and a downsized computer. In a preferred embodiment, the communications card comprises a retractable access portion and a fixed portion. The retractable access portion has an aperture formed therein configured to receive the media connector. A conductive terminal having a first and a second end mates with both the retractable access portion and the fixed portion. The first end makes electrical contact with the media connector while, simultaneously, the second end slidingly makes electrical contact with the fixed portion as the retractable access portion is extended beyond the computer housing during use. The sliding contact is accomplished by means of a conductive track disposed on the fixed portion. Since the fixed portion is in electrical communication with the computer, the media connector is also in electrical communication with the computer. A contact block may additionally be provided to align and electrically isolate the conductive track.

It is also a feature of the present invention to provide a pin block having pivoting action to accommodate the conductive terminal to extend longevity of the conductive terminal and to ensure better electrical contact with the conductive track during use.

These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

In accordance with the present invention, an improved electrical connector is provided for use between a media connector and a communications card in a computer system. It is a feature of the present invention to substantially eliminate solder joints and flexing wire conductors from the electrical connector to improve internal spatial arrangements and the reliability thereof.

As used herein, a "PCMCIA communications card" or "communications card" refers to a communications card falling within the memory card parameters defined by the Personal Computer Memory Card International Association having a thickness less than the thickness of a miniature modular jack physical/electrical media connector. Accordingly, a communications card also refers to PCMCIA architecture modem cards, PCMCIA architecture network cards, such as a LAN, or equivalents thereof.

As used herein, a "miniature modular jack physical/electrical media connector" or "media connector" connotes a media connector such as those connectors having physical attributes described in F.C.C. part 68, subpart F, expressly incorporated herein by reference. Specific media connectors such as a RJ-11 or a RJ-45 are merely references to a specific exemplary media connector falling within the broader parameters of the term "media connector" and should not be used to limit the scope of the present invention to specific connectors.

Figure 1:
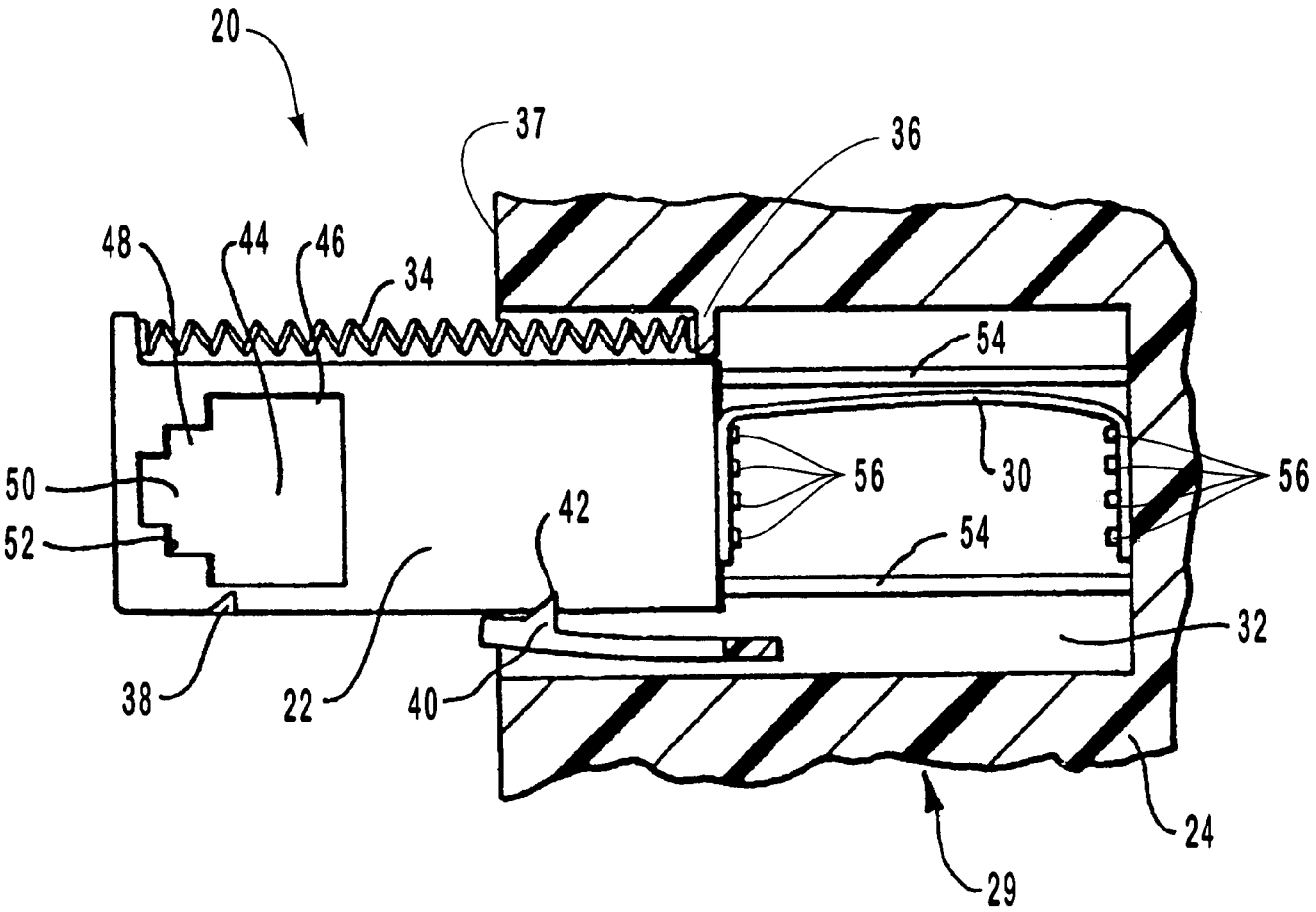
FIG. 1 (PRIOR ART)
FIG. 1 is a plan view of a prior art sliding interface device having a flexible wire ribbon connector for electrically connecting a media connector with a communications card.
Figure 2:
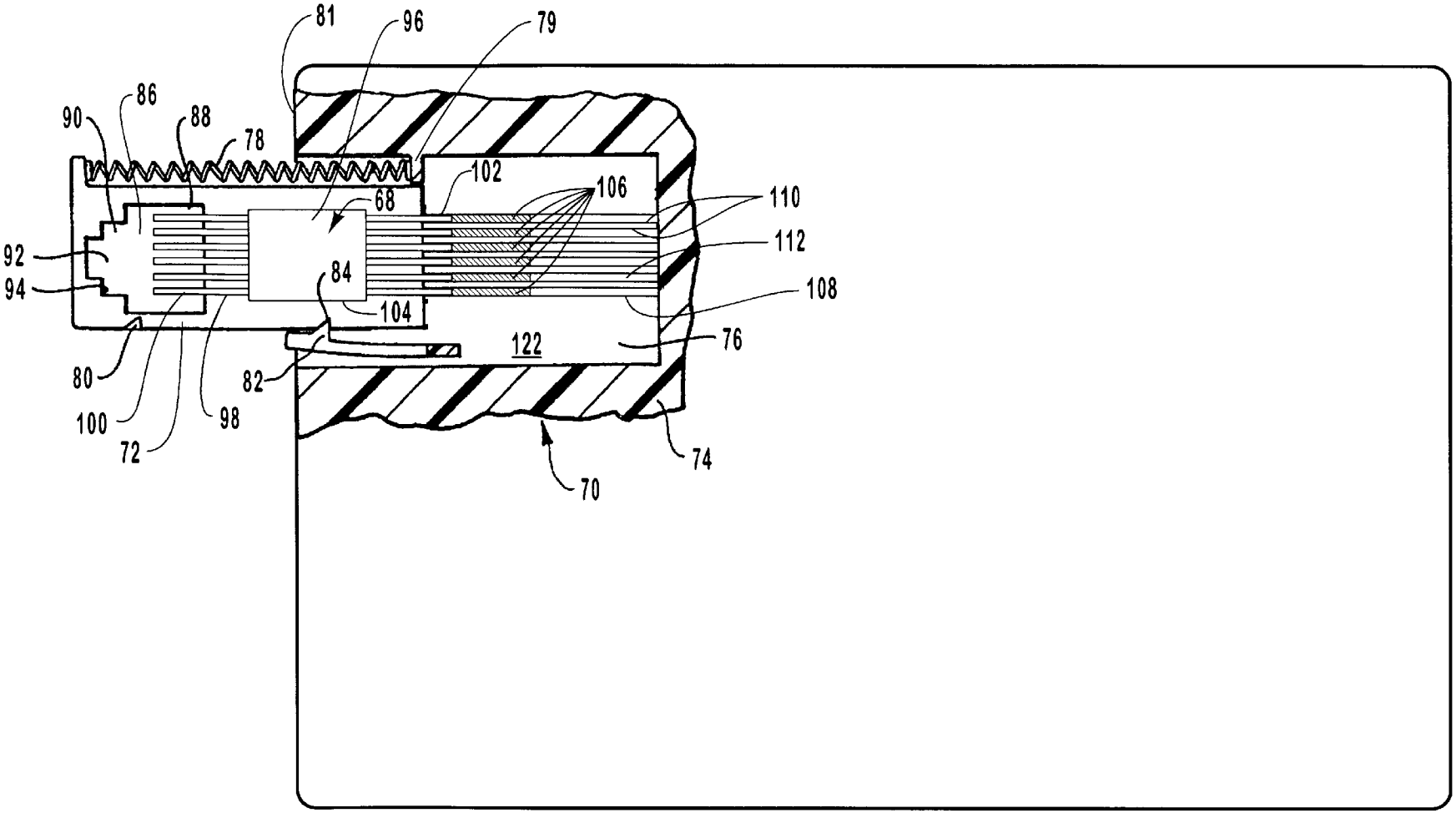
FIG. 2 is a plan view of a communications card in accordance with the present invention having a sliding interface electrical connector for electrically connecting a media connector with the communications card.

With reference to FIG. 2, a sliding interface electrical connector in accordance with the present invention for ultimately providing electrical communication between a media connector (not shown) and a computer (not shown) is depicted generally as 68. The sliding interface electrical connector 68 is defined by a communications card 70 having a retractable access portion 72 and a fixed portion 74.

The fixed portion 74 is in electrical communication with the computer by means of electronic circuitry connected on a printed circuit board (PCB) housed internally within the communications card 70. As used herein, fixed portion 74 shall refer to the generally stationary features internal to the communications card. Such features include, but are not limited to, the PCB, the electronic circuitry thereon, the mechanical spacers and connectors used to physically connect the PCB to the communications card. The retractable access portion 72 is in electrical communication with fixed portion 74 through the sliding interface electrical connector 68, described in detail below.

During use, in means well known in the art, the retractable access portion 72 slides in and out of a slot 76 formed within the fixed portion 74. The retractable portion 72 is urged out of the slot 76 by a spring 78 biased, in a direction external to the computer housing, by a ledge 79 connected to the fixed portion 74. Although not shown, the computer housing during use is substantially parallel to an edge 81 of the communications card 70. A limiting notch 84 engaged by a biased lever 82 is used to restrict the travel distance of the retractable access portion 72 to a predetermined distance when the retractable access portion is urged in a direction external to the computer housing by the spring 78. After use, a retention notch 80 in combination with the biased lever 82 is used to retain the retractable access portion 72 within the housing of the computer and the housing of the communications card.

An aperture 86 having a plurality of walls 88 is formed within the retractable access portion 72. The aperture 86 is so sized and shaped as to be capable of receiving a media connector. Formed within aperture 86 by means of walls 88 is a broad retention clip groove 90, a narrow retention clip groove 92, and a retention ridge 94. These structures within aperture 86 provide for the retention of a connector pin block of a media connector.

When a user desires to connect a telephone line to the communications card, biased lever 82 is manipulated out of retention notch 80. As retractable access portion 72 is released from the grip of biased lever 82, tension applied by spring 78 urges retractable access portion 72 out of slot 76. The progress of retractable access portion 72 is guided by portions (defined later) of the sliding interface electrical connector 68 and is halted when biased lever 82 engages limiting notch 84. A user then inserts at least a portion of a media connector into aperture 86 to provide an electrical connection between communications card 70 and the telephone line. When a user no longer desires to access the retractable access portion 72, the user merely presses retractable access portion 72 back within the confines of the computer housing until the retention notch 80 is engaged by biased lever 82.

However, it should be appreciated that even further biasing means, aperture embodiments for accepting a media connector during use and retention means for stabilizing the media connector, for example, are contemplated within the scope of the present invention and are more fully described in U.S. Pat. Nos., 5,183,404, 5,336,099 and 5,338,210. All three of these patents are expressly incorporated herein by reference.

The sliding interface electrical connector 68 comprises a pin block 96 for accommodating at least one conductive terminal or lead 98. In FIG. 2, six conductive leads being in substantially parallel arrangement are illustrated. Each conductive lead 98 has a first end 100 and a second end 102. It should be appreciated, however, that the conductive lead is preferably one singular conductive material and the first and second ends simply describe portions of the conductive lead 98 that extend beyond a boundary 104 of pin block 96 on opposite sides thereof. Preferably, the conductive lead is inserted within and molded contiguously with the pin block 96 in a well known manufacturing technique often referred to as "insert molding."

The first end 100 of the conductive lead 98 is for making electrical contact with the media connector during use when the media connector is inserted into aperture 86. Preferably, the first end 100 extends at least partially into the aperture 86 for electrically contacting the necessary conductors of the media connector. The necessary conductors of an RJ-11 media connector usually include the "tip and ring" lines.

The second end 102 of the conductive lead 98 is for slidingly making electrical contact with a conductive track 106. The conductive track 106 is an elongated conductive material of sufficient length that allows for a sliding electrical contact of the second end 102 throughout the range of motion as the retractable access portion is extended beyond the housing of the computer. The conductive track is preferably a metal, such as aluminum, copper, gold, silver, combinations thereof and similar other metals and metal combinations, but is not required to be. The conductive track 106 is also of sufficient length to maintain electrical contact with the second end even when the retractable access portion 72 is inadvertently bumped during use and caused to slide in a direction generally towards the computer. When this inadvertent sliding occurs, the retractable access portion 72 is only able to travel towards the computer housing until the media connector, inserted in the aperture 86, is prevented from further travel as it abuts against the computer housing. Thus, if the inadvertent sliding of the retractable access portion 72 remains as a possibility, the conductor tracks only need to be of a length sufficient to electrically contact the second end 102 when the retractable access portion is fully extended and when the media connector, during use, is pushed and abutted against the housing.

It should be appreciated that since the conductive track 106 is in electrical communication with the fixed portion 74, the second end 102 is simultaneously in electrical communication with the fixed portion 74. In turn, the first end 100 of the conductive lead 98 is also in electrical communication with the fixed portion 74. Thus, during use, when conductive lines of the media connector electrically contact the first end 100, the media connector is in electrical communication with the computer via the fixed portion 74.

A contact block 108 is provided to align the conductor tracks 106 and electrically isolate each conductor track from adjacent conductor tracks. Preferably, the conductor tracks 106 are towards a bottom of the contact block so that a plurality of barriers 110 protruding upwardly from the bottom 112 of the contact block can better serve to guide the second end 102 of the conductive terminal 98 as the second end 102 slides back and forth along the conductive track as the retractable access portion 72 is slid back and forth in slot 76. For descriptive purposes only, the barriers 110 can be loosely analogized to the gutters surrounding a bowling lane. In one embodiment, the contact block 108 is interengaged with a corresponding guide groove (not shown) formed in the bottom of retractable access portion 72 to facilitate the sliding back and forth of the retractable access portion.

In another embodiment, the contact block 108 is isolated from the structure of the retractable access portion. For example, with reference to FIG. 3, the contact block 108 fits laterally within the frame 114 of the retractable access portion 72. In this embodiment, the contact block 108 electrically mates with the fixed portion 74 by leads 116 at one end of the contact block. The leads 116 are insert molded with the contact block and are in electrical communication with the conductor tracks 106 that are recessed between barriers 110.

During use, to facilitate the retraction of the retractable access portion 72 within the housing of the computer, the conductor tracks have a sloping portion thereof defined by the sloping contour 118 of the contact block at another end thereof. This allows the second end 102 of the conductive lead 98 to travel away from a bottom 112 of the contact block when the retractable access portion 74 is urged back into the communications card.

Also depicted in this embodiment is a generally "J" shaped, curved terminal portion 120 of the second end 102. In this manner, the curved terminal portion 120 more easily slides along the conductor tracks 106 which facilitates the sliding electrical contact therebetween. Moreover, since the curved terminal portion is not straight, there is less scraping of the conductive materials configured into the conductor tracks.

In one embodiment, the conductor tracks 106 are a palladium-nickel compound having a flash of gold deposited thereupon. This compound, commonly known as an "80-20 plating" beneficially reduces potential clogging of the contact block that might be caused by the gentle erosion of the gold flash of the conductor track as the second end 102 of the leads 98 scrapes there against over time. In general, since it is known that gold is "attracted" by palladium, as the gold flash is eroded by the movement of the second end of the conductive lead, the gold particles attach themselves to the palladium base and keeps the gold flash from sliding between barriers 110 during use.

In another embodiment, the contact block 108 can be configured specifically on the PCB of the fixed portion 74 instead of therebetween. In this manner, appropriately shaped second ends would need to be configured that extend from the pin block to the contact block. Such appropriately shaped second ends might include, but are not limited to, generally "L" shaped leads that extend straightward from the pin block 96 and then sideways onto the PCB and the conductor tracks.

Figures 3, 4:
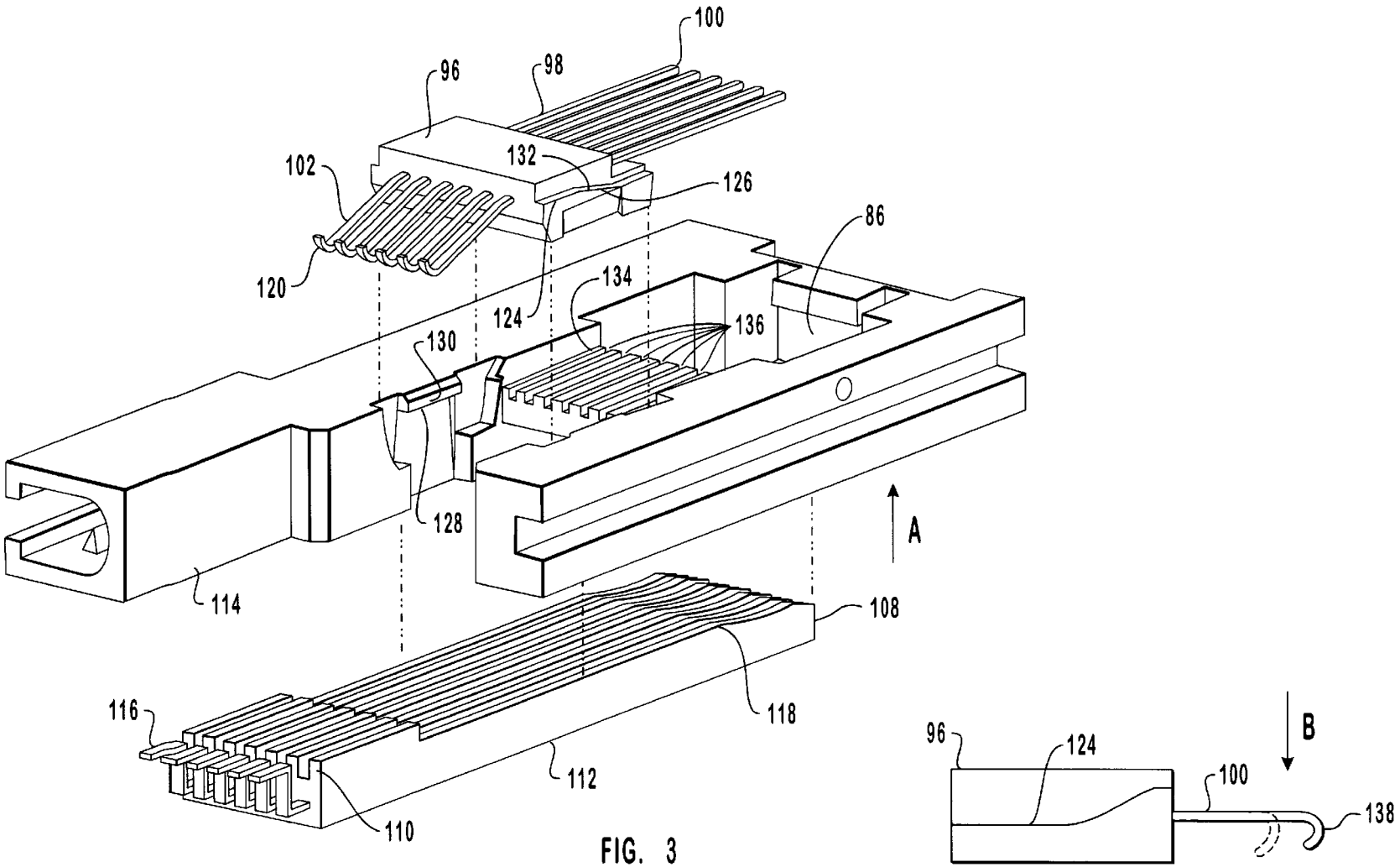
FIG. 3 is an exploded view of the sliding interface electrical connector of FIG. 2.
FIG. 4 is a side view of a portion of a sliding interface electrical connector depicting a pin block and electrical terminals thereof for electrically contacting a media connector according to alternative embodiment of the present invention.

From FIG. 3 it should be appreciated that the contact block 108 does not in any fashion interfere with the sliding action of the retractable access portion 72 during use. In this manner, the spatial limitations of the prior art flexible wire ribbons are overcome. Since the contact block 108 does not require any more space than that previously discussed, the tracks can be made relatively short. In turn, the PCB can be enlarged within the confines of the communications card 70 to provide more room or space for components. A larger PCB will also provide increased structural stability to the PCB. This embodiment also eliminates all problems associated with having flexing conductive wires in prior art flexible style wire bundle. Thus, since there are no conductors that are being flexed, longevity of the electrical connections will be greatly improved. Similarly, since electrical connections are made and maintained by a sliding action, the problems associates with fragile solder joints are also overcome.

Manufacturing is also advantageously improved with the present invention. For example, it is contemplated that the contact block 108 can be inexpensively fabricated as a singular piece onto a surface 122 of the communications card 70 (FIG. 2). Such fabrication techniques include, but are not limited to, "clam shell" designs where about "half" of the contact block is "pre-fabricated" on one surface of the communications card and the other "half" is "pre-fabricated" on the opposing surface of the communications card. The two halves are brought together and simultaneously cured as one homogenous piece. Another fabrication technique includes the simple molding of the contact block and adhering it to the communications card with well known adhesives.

Although depicted as within the contact block, it should be appreciated that the conductor tracks can be fabricated in various other arrangements. For example, the contact block itself can be removed and the conductor tracks can be directly disposed onto the surface 122 of the communications card 70 (FIG. 2). The conductor tracks can also be deposited directly on the PCB without a guiding contact block. Similarly, "L" shaped second ends of the conductive leads can be used to slidingly electrically contact conductor tracks on the PCB. 108 contact block can also be configured such that it can be surface mounted to the PCB by means of automated pick and place machinery.

Another advantageous feature of this invention is the pivoting action of pin block 96. On both ends of the pin block 96 is a ledge 124 having a sloping potion 126 thereof. This ledge 124, mates generally underneath a surface 128 of an end stop 130 that protrudes from the frame 114 of the retractable access portion 72. During use, as a media connector is inserted generally upward in the general direction of arrow A, the media connector urges the first ends 100 of the conductive leads into a counter-clockwise motion and the ledge 124 of the pin block 96 and the surface 128 of the end stop are urged together. Since the ledge 124 is sloped along sloping portion 126, the pin block pivots until the top surface 132 of the ledge 124 abuts against the surface 128 of the end stop. In this manner, the pivotable mounting arrangement provides for extended longevity ("wear and tear") on the first ends of the conductive leads unlike prior art devices which cannot pivot and cannot absorb the pressure exerted there against by a media connector during use. A further benefit of the pivoting action of the pin block is that when the pin block is counter-clockwise rotated, the second ends 102 of the conductive leads are rotated into and held tighter against the conductive tracks within the contact block. This substantially ensures electrical connection throughout the period when the media connector is inserted into the aperture 86.

The frame 114 of the retractable access portion 72 comprises a shelf 134 that provides structural stability to the frame. The shelf facilitates reception of the media connector during use and allows the first ends to rest thereon during "non-electrical use," i.e., when the media connector is not inserted into aperture 86. In a preferred embodiment, a plurality of grooves 136 for matingly receiving and aligning with the first ends 100 of the conductive leads 98 are carved into the shelf 134.

With reference to FIG. 4, the pin block 96 may alternatively accommodate first ends 100 which, instead of terminating in a substantially straight manner, terminate in a rounded portion 138. In this manner, as the media connector mates with the first ends, generally in the direction of arrow B, the rounded portions 138 flex generally downward and inward towards the pin block 96 as illustrated in phantom. The rounded portions 138 then allow for a shortened distance that the first ends must extend into the aperture. In turn, the pin block is brought closer to the aperture 86 and the conductive tracks and/or contact block can be even further shortened. Again, increased space within the communications card allows for more room on the PCB. Shortened conductive tracks and contact blocks also allow for decreased materials cost since, for example, the conductive tracks are not as large.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A communications card for use in interfacing between a media connector and a downsized computer, comprising:

a retractable access portion having an aperture formed therein configured to receive at least a portion of said media connector, at least a portion of said aperture extending completely through said retractable access portion;

a fixed portion being capable of making electrical contact with said downsized computer during use;

a conductive terminal having a first end and a second end, said first end for making electrical contact with said media connector during use;

a pin block for accommodating a portion of said conductive terminal, said first and second ends of said conductive terminal extending beyond said pin block on opposite sides thereof; and a conductive track for slidingly making electrical contact with said second end of said conductive terminal during use as said retractable access portion is extended, said conductive track being in electrical communication with said fixed portion.

2. A communications card according to claim 1, wherein said second end of said conductive terminal has a curved terminal portion thereof for facilitating said sliding electrical contact between said conductive terminal and said conductive track.

3. A communications card according to claim 1, wherein said conductive track is aligned on said fixed portion by a contact block.

4. A communications card according to claim 1, wherein said conductive track has a sloping contour thereof to facilitate the retraction of said retractable access portion.

5. A communications card according to claim 1, wherein said conductive terminal is pivotably mounted with said retractable access portion.

6. A communications card according to claim 1, wherein said retractable access portion further comprises a shelf for providing structural stability thereto and for facilitating reception of said media connector, said shelf having a groove therein for facilitating alignment between said conductive terminal and said media connector during use.

7. A communications card according to claim 1, wherein said retractable access portion further comprises an end stop for facilitating mounting of said conductive terminal thereto.

8. A communications card according to claim 1, wherein said conductive track is on a printed circuit board of said fixed portion.

9. A direct connection system for removably engaging a media connector with a communications card, comprising:

a communications card having a retractable access portion and a fixed portion, said fixed portion being capable of making electrical contact with said downsized computer during use;

an aperture formed in said retractable access portion configured to receive at least a portion of said media connector, at least a portion of said aperture extending completely through said retractable access portion;

at least one conductive lead having a first end and a second end, said first end extending partially into said aperture for making electrical contact with said media connector during use; and at least one conductive track for slidingly making electrical contact with said second end of said at least one conductive lead during use as said retractable access portion is extended beyond said housing of said downsized computer, said at least one conductive track being in electrical communication with said fixed portion, said at least one conductive track including a sloping contour to facilitate the retraction of said retractable access portion.

10. A direct connection system according to claim 9, wherein said at least one conductive lead is pivotably mounted with said retractable access portion.

11. A direct connection system for removably engaging a media connector with a communications card, comprising:

a communications card having a retractable access portion and a fixed portion, said fixed portion being capable of making electrical contact with said downsized computer during use;

an aperture formed in said retractable access portion configured to receive at least a portion of said media connector;

at least one conductive lead having a first end and a second end, said first end extending partially into said aperture for making electrical contact with said media connector during use, wherein said at least one conductive lead is pivotably mounted with said retractable access portion;

at least one conductive track for slidingly making electrical contact with said second end of said at least one conductive lead during use as said retractable access portion is extended beyond said housing of said downsized computer, said at least one conductive track being in electrical communication with said fixed portion; and a pin block for accommodating said at least one conductive lead, said pin block being pivotably mounted with said retractable access portion.

12. A direct connection system according to claim 11, wherein said pin block comprises a ledge for mating with an end stop on said retractable access portion, said ledge having a sloping portion thereof for facilitating said pivotable mounting.

13. A direct connection system according to claim 12, wherein said first and second ends extend beyond said pin block on opposite sides thereof.

14. A direct connection system according to claim 13, wherein said second end of said at least one conductive lead has a curved terminal portion thereof for facilitating said sliding electrical contact between said at least one conductive lead and said at least one conductive track.

15. A communications card for use in interfacing between a media connector and a computer, comprising:

a retractable access portion having an aperture formed therein configured to receive at least a portion of said media connector, at least a portion of said aperture extending completely through said retractable access portion;

a fixed portion having a printed circuit board, said printed circuit board being capable of making electrical contact with said computer during use;

a plurality of conductive terminals being pivotably mounted with said retractable access portion, each said conductive terminal having a first end and a second end, said first end for pivotably making electrical contact with said media connector during use; and a plurality of conductive tracks for slidingly making electrical contact with each said second end of said conductive terminals during use as said retractable access portion is extended beyond a housing of said computer, said conductive tracks being in electrical communication with said printed circuit board, said conductive tracks including a sloping contour to facilitate the retraction of said retractable access portion.

16. A communications card for use in interfacing between a media connector and a computer, comprising:

a retractable access portion having an aperture formed therein configured to receive at least a portion of said media connector;

a fixed portion having a printed circuit board, said printed circuit board being capable of making electrical contact with said computer during use;

a plurality of conductive terminals being pivotably mounted with said retractable access portion, each said conductive terminal having a first end and a second end, said first end for pivotably making electrical contact with said media connector during use a plurality of conductive tracks for slidingly making electrical contact with each said second end of said conductive terminals during use as said retractable access portion is extended beyond a housing of said computer, said conductive tracks being in electrical communication with said printed circuit board; and a pin block for accommodating said conductive terminals.

17. A communications card according to claim 16, wherein said pin block further comprises a ledge for interfacing with a surface of an end stop on said retractable access portion, said ledge having a sloping portion thereof for facilitating said pivotable mounting when said ledge and said surface are urged together.

18. A communications card for use in interfacing between a media connector and a computer, comprising:

a retractable access portion having an aperture formed therein configured to receive at least a portion of said media connector;

a fixed portion having a printed circuit board, said printed circuit board being capable of making electrical contact with said computer during use;

a plurality of conductive terminals being pivotably mounted with said retractable access portion, each said conductive terminal having a first end and a second end, said first end for pivotably making electrical contact with said media connector during use a plurality of conductive tracks for slidingly making electrical contact with each said second end of said conductive terminals during use as said retractable access portion is extended beyond a housing of said computer, said conductive tracks being in electrical communication with said printed circuit board; and a contact block for aligning and electrically isolating each said conductive track from every other said conductive track.

19. A communications card according to claim 18, wherein said conductive track extends along a portion of said contact block of sufficient length to only slidingly electrically contact said conductive terminals with said conductive tracks when said retractable access portion is extended beyond said housing of said computer.

20. A communications card according to claim 15, wherein said conductive tracks are electrically arranged on said printed circuit board or said fixed portion.

21. A communications card according to claim 15, wherein said conductive tracks are conductively configured as a palladium nickel conductor with a flash of gold thereupon.

22. A communications connection system allowing connection of a media connector to a downsized portable computer, comprising:

a downsized portable computer having a communications card slot in a housing thereof;

a communications card capable of being inserted into said slot, said communications card having:

(i) a retractable access portion having an aperture formed therein configured to receive at least a portion of said media connector, at least a portion of said aperture extending completely through said retractable access portion;

(ii) a fixed portion being capable of making electrical contact with said computer during use;

(iii) a conductive terminal having a first end and a second end, said first end for making electrical contact with said media connector during use;

(iv) a conductive track for slidingly making electrical contact with said second end of said conductive terminal during use as said retractable access portion is extended to a position outside of said housing to expose said aperture outside of said housing for reception of said media connection, said conductive track being in electrical communication with said fixed portion; and (v) a pin block for accommodating a portion of said conductive terminal.

23. A communications connection system according to claim 22, wherein said communications card comprises a PCMCIA architecture modem card or a PCMCIA architecture network card.

24. A communications connection system according to claim 22, wherein said aperture is configured to accept at least a portion of a RJ-11 or RJ-45 media connector.

* * * * *

UNITED STATES PATENT AND TRADEMARK OFFICE

CERTIFICATE OF CORRECTION

PATENT NO. : 6,116,927
DATED : September 12, 2000
INVENTOR(S) : Thomas A. Johnson; John D. Frampton; Donald C. Paul; Jeffrey S. Terrell It is certified that error appears in the above-identified patent and that said Letters Patent is hereby corrected as shown below:

Title page,
Item [56], in "References Cited", the last U.S. Patent Document listed change "Gilad" to -- Glad --

Column 11,
Line 11, before "This embodiment" start a new paragraph
Line 45, after "sloping" change "potion" to -- portion --

Column 12,
Line 60, before "conductive terminal" insert -- second end of said --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*